US009856634B2

(12) United States Patent
Rodenbeck et al.

(10) Patent No.: US 9,856,634 B2
(45) Date of Patent: Jan. 2, 2018

(54) FLUID DELIVERY DEVICE WITH AN IN-WATER CAPACITIVE SENSOR

(71) Applicant: DELTA FAUCET COMPANY, Indianapolis, IN (US)

(72) Inventors: Robert W. Rodenbeck, Indianapolis, IN (US); Anthony G. Spangler, Indianapolis, IN (US); Michael J. Veros, Carmel, IN (US); Paul D. Koottungal, Leander, TX (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 14/986,582

(22) Filed: Dec. 31, 2015

(65) Prior Publication Data

US 2016/0122983 A1 May 5, 2016

Related U.S. Application Data

(63) Continuation of application No. 13/400,541, filed on Feb. 20, 2012, now Pat. No. 9,228,329, which is a continuation of application No. 11/700,556, filed on Jan. 31, 2007, now Pat. No. 8,118,240.

(60) Provisional application No. 60/794,229, filed on Apr. 20, 2006, provisional application No. 60/793,885, filed on Apr. 20, 2006.

(51) Int. Cl.
*E03C 1/05* (2006.01)
*E03C 1/04* (2006.01)

(52) U.S. Cl.
CPC ..... *E03C 1/057* (2013.01); *E03C 1/0404* (2013.01); *E03C 2001/0415* (2013.01); *E03C 2001/0417* (2013.01); *Y10T 137/0318* (2015.04); *Y10T 137/9464* (2015.04)

(58) Field of Classification Search
CPC ..... E03C 1/057; E03C 2001/0415; Y10T 137/9464; Y10T 137/0318
USPC ..... 239/67, 71, 73, 68, 74, 407, 569, 568; 4/623; 137/801; 251/129.04
See application file for complete search history.

(56) References Cited

U.S. PATENT DOCUMENTS

| | | | |
|---|---|---|---|
| 2,337,321 | A | 12/1943 | Freeman |
| 2,991,481 | A | 7/1961 | Book |
| 3,081,594 | A | 3/1963 | Atkins et al. |
| 3,151,340 | A | 10/1964 | Teshima |
| 3,254,313 | A | 5/1966 | Atkins et al. |
| 3,314,081 | A | 4/1967 | Atkins et al. |
| 3,406,941 | A | 10/1968 | Ichimori et al. |
| 3,588,038 | A | 6/1971 | Tanaka |

(Continued)

FOREIGN PATENT DOCUMENTS

| | | |
|---|---|---|
| CA | 2492226 A1 | 7/2005 |
| DE | 3339849 | 5/1985 |

(Continued)

OTHER PUBLICATIONS

KWC AG, Kitchen Faucet 802285 Installation and Service Instructions, dated Jul. 2005, 8 pgs.

(Continued)

*Primary Examiner* — Jason Boeckmann
(74) *Attorney, Agent, or Firm* — Faegre Baker Daniels LLP

(57) ABSTRACT

A pull-out wand is disclosed for use with a water delivery device. The pull-out wand may include one or more sensors, such as a touch sensor and/or a proximity sensor.

21 Claims, 7 Drawing Sheets

(56) References Cited

U.S. PATENT DOCUMENTS

| | | | |
|---|---|---|---|
| 3,651,989 | A | 3/1972 | Westrich |
| 3,672,479 | A | 6/1972 | Schwertfeger et al. |
| 3,685,541 | A | 8/1972 | Braucksick et al. |
| 3,705,574 | A | 12/1972 | Duncan |
| 3,756,456 | A | 9/1973 | Georgi |
| 3,762,440 | A | 10/1973 | Bryant |
| 3,799,171 | A | 3/1974 | Patel |
| 3,987,819 | A | 10/1976 | Scheuermann |
| 4,172,381 | A | 10/1979 | Aigner |
| 4,185,336 | A | 1/1980 | Young |
| 4,200,018 | A | 4/1980 | Sekiwa |
| 4,201,518 | A | 5/1980 | Stevenson |
| 4,280,530 | A | 7/1981 | Yi |
| 4,331,292 | A | 5/1982 | Zimmer |
| 4,337,388 | A | 6/1982 | July |
| 4,359,186 | A | 11/1982 | Kiendl |
| 4,406,313 | A | 9/1983 | Bennett et al. |
| 4,407,444 | A | 10/1983 | Knebel et al. |
| 4,409,694 | A | 10/1983 | Barrett et al. |
| 4,410,791 | A | 10/1983 | Eastep |
| 4,420,811 | A | 12/1983 | Tarnay et al. |
| 4,421,269 | A | 12/1983 | Ts'ao |
| 4,424,767 | A | 1/1984 | Wicke et al. |
| 4,429,422 | A | 2/1984 | Wareham |
| 4,436,983 | A | 3/1984 | Solobay |
| 4,439,669 | A | 3/1984 | Ryffel |
| 4,450,829 | A | 5/1984 | Morita et al. |
| 4,459,465 | A | 7/1984 | Knight |
| 4,503,575 | A | 3/1985 | Knoop et al. |
| 4,532,962 | A | 8/1985 | Campau |
| 4,537,348 | A | 8/1985 | Gossi |
| 4,541,562 | A | 9/1985 | Zukausky |
| 4,554,688 | A | 11/1985 | Puccerella |
| 4,563,780 | A | 1/1986 | Pollack |
| 4,567,350 | A | 1/1986 | Todd, Jr. |
| 4,581,707 | A | 4/1986 | Millar |
| 4,584,463 | A | 4/1986 | Klages et al. |
| 4,604,515 | A | 8/1986 | Davidson |
| 4,604,764 | A | 8/1986 | Enzo |
| 4,606,325 | A | 8/1986 | Lujan |
| 4,611,757 | A | 9/1986 | Saether |
| 4,628,902 | A | 12/1986 | Comber |
| 4,638,147 | A | 1/1987 | Dytch et al. |
| 4,674,678 | A | 6/1987 | Knebel et al. |
| 4,680,446 | A | 7/1987 | Post |
| 4,682,581 | A | 7/1987 | Laing et al. |
| 4,682,728 | A | 7/1987 | Oudenhoven et al. |
| 4,688,277 | A | 8/1987 | Kakinoki et al. |
| 4,693,415 | A | 9/1987 | Sturm |
| 4,700,884 | A | 10/1987 | Barrett et al. |
| 4,700,885 | A | 10/1987 | Knebel |
| 4,709,728 | A | 12/1987 | Ying-Chung |
| 4,713,525 | A | 12/1987 | Eastep |
| 4,735,357 | A | 4/1988 | Gregory et al. |
| 4,738,280 | A | 4/1988 | Oberholtzer |
| 4,742,456 | A | 5/1988 | Kamena |
| 4,750,472 | A | 6/1988 | Fazekas |
| 4,753,265 | A | 6/1988 | Barrett et al. |
| 4,756,030 | A | 7/1988 | Juliver |
| 4,757,943 | A | 7/1988 | Sperling et al. |
| 4,768,705 | A | 9/1988 | Tsutsui et al. |
| 4,786,782 | A | 11/1988 | Takai et al. |
| 4,798,224 | A | 1/1989 | Haws |
| 4,808,793 | A | 2/1989 | Hurko |
| 4,832,259 | A | 5/1989 | Vandermeyden |
| 4,854,498 | A | 8/1989 | Stayton |
| 4,869,287 | A | 9/1989 | Pepper et al. |
| 4,869,427 | A | 9/1989 | Kawamoto et al. |
| 4,870,986 | A | 10/1989 | Barrett et al. |
| 4,872,485 | A | 10/1989 | Laverty |
| 4,875,623 | A | 10/1989 | Garris |
| 4,893,653 | A | 1/1990 | Ferrigno |
| 4,896,658 | A | 1/1990 | Yonekubo et al. |
| 4,901,915 | A | 2/1990 | Sakakibara |
| 4,909,435 | A | 3/1990 | Kidouchi et al. |
| 4,914,758 | A | 4/1990 | Shaw |
| 4,916,613 | A | 4/1990 | Lange et al. |
| 4,917,142 | A | 4/1990 | Laing et al. |
| 4,923,116 | A | 5/1990 | Homan |
| 4,930,551 | A | 6/1990 | Haws |
| 4,936,289 | A | 6/1990 | Peterson |
| 4,936,508 | A | 6/1990 | Ingalz |
| 4,941,608 | A | 7/1990 | Shimizu et al. |
| 4,945,942 | A | 8/1990 | Lund |
| 4,945,943 | A | 8/1990 | Cogger |
| 4,955,535 | A | 9/1990 | Tsutsui et al. |
| 4,965,894 | A | 10/1990 | Baus |
| 4,967,794 | A | 11/1990 | Tsutsui et al. |
| 4,969,598 | A | 11/1990 | Garris |
| 4,970,373 | A | 11/1990 | Lutz et al. |
| 4,971,106 | A | 11/1990 | Tsutsui et al. |
| 4,998,673 | A | 3/1991 | Pilolla |
| 5,009,572 | A | 4/1991 | Imhoff et al. |
| 5,020,127 | A | 5/1991 | Eddas et al. |
| 5,033,508 | A | 7/1991 | Laverty |
| 5,033,715 | A | 7/1991 | Chiang |
| 5,040,106 | A | 8/1991 | Maag |
| 5,042,524 | A | 8/1991 | Lund |
| 5,056,712 | A | 10/1991 | Enck |
| 5,057,214 | A | 10/1991 | Morris |
| 5,058,804 | A | 10/1991 | Yonekubo et al. |
| 5,063,955 | A | 11/1991 | Sakakibara |
| 5,086,526 | A | 2/1992 | Van Marcke |
| 5,095,945 | A | 3/1992 | Jensen |
| 5,105,846 | A | 4/1992 | Britt |
| 5,124,934 | A | 6/1992 | Kawamoto et al. |
| 5,125,433 | A | 6/1992 | DeMoss et al. |
| 5,129,034 | A | 7/1992 | Sydenstricker |
| 5,133,089 | A | 7/1992 | Tsutsui et al. |
| 5,139,044 | A | 8/1992 | Otten et al. |
| 5,143,049 | A | 9/1992 | Laing et al. |
| 5,148,824 | A | 9/1992 | Wilson et al. |
| 5,170,361 | A | 12/1992 | Reed |
| 5,170,514 | A | 12/1992 | Weigert |
| 5,170,816 | A | 12/1992 | Schnieders |
| 5,170,944 | A | 12/1992 | Shirai |
| 5,174,495 | A | 12/1992 | Eichholz et al. |
| 5,175,892 | A | 1/1993 | Shaw |
| 5,183,029 | A | 2/1993 | Ranger |
| 5,184,642 | A | 2/1993 | Powell |
| 5,187,816 | A | 2/1993 | Chiou |
| 5,202,666 | A | 4/1993 | Knippscheer |
| 5,205,318 | A | 4/1993 | Massaro et al. |
| 5,206,963 | A | 5/1993 | Wiens |
| 5,217,035 | A | 6/1993 | Van Marcke |
| 5,224,509 | A | 7/1993 | Tanaka et al. |
| 5,226,629 | A | 7/1993 | Millman et al. |
| 5,261,443 | A | 11/1993 | Walsh |
| 5,262,621 | A | 11/1993 | Hu et al. |
| 5,265,318 | A | 11/1993 | Shero |
| 5,277,219 | A | 1/1994 | Lund |
| 5,287,570 | A | 2/1994 | Peterson et al. |
| 5,315,719 | A | 5/1994 | Tsutsui et al. |
| 5,323,803 | A | 6/1994 | Blumenauer |
| 5,325,822 | A | 7/1994 | Fernandez |
| 5,334,819 | A | 8/1994 | Lin |
| 5,341,839 | A | 8/1994 | Kobayashi et al. |
| 5,348,231 | A | 9/1994 | Arnold et al. |
| 5,351,712 | A | 10/1994 | Houlihan |
| 5,358,177 | A | 10/1994 | Cashmore |
| 5,361,215 | A | 11/1994 | Tompkins et al. |
| 5,362,026 | A | 11/1994 | Kobayashi et al. |
| 5,385,168 | A | 1/1995 | Lund |
| 5,400,961 | A | 3/1995 | Tsutsui et al. |
| 5,408,578 | A | 4/1995 | Bolivar |
| 5,409,037 | A | 4/1995 | Wheeler et al. |
| 5,419,930 | A | 5/1995 | Schucker |
| 5,429,272 | A | 7/1995 | Luigi |
| 5,431,302 | A | 7/1995 | Tulley et al. |
| 5,433,342 | A | 7/1995 | Luro |
| 5,437,003 | A | 7/1995 | Blanco |
| RE35,018 | E | 8/1995 | Homan |
| 5,438,642 | A | 8/1995 | Posen |
| 5,467,967 | A | 11/1995 | Gillooly |

(56) References Cited

U.S. PATENT DOCUMENTS 5,479,558 A 12/1995 White et al.
5,482,250 A 1/1996 Kodaira
5,504,306 A 4/1996 Russell et al.
5,504,950 A 4/1996 Natalizia et al.
5,511,579 A 4/1996 Price
5,511,723 A 4/1996 Eki et al.
5,540,555 A 7/1996 Corso et al.
5,550,753 A 8/1996 Tompkins et al.
5,564,462 A 10/1996 Storch
5,566,702 A 10/1996 Philipp
5,570,869 A 11/1996 Diaz et al.
5,572,985 A 11/1996 Benham
5,575,424 A 11/1996 Fleischmann
5,577,660 A 11/1996 Hansen
5,584,316 A 12/1996 Lund
5,586,572 A 12/1996 Lund
5,588,636 A 12/1996 Eichholz et al.
5,595,342 A 1/1997 McNair et al.
5,603,344 A 2/1997 Hall
5,610,589 A 3/1997 Evans et al.
5,622,203 A 4/1997 Givler et al.
5,623,990 A 4/1997 Pirkle
5,627,375 A 5/1997 Hsieh
5,682,032 A 10/1997 Philipp
5,694,653 A 12/1997 Harald
5,730,165 A 3/1998 Philipp
5,735,291 A 4/1998 Kaonohi
5,739,165 A * 4/1998 Makino ..... A61K 9/2077 514/570
5,758,688 A 6/1998 Hamanaka et al.
5,769,120 A 6/1998 Laverty et al.
5,775,372 A 7/1998 Houlihan
5,784,531 A 7/1998 Mann et al.
5,790,024 A 8/1998 Ripingill et al.
5,812,059 A 9/1998 Shaw et al.
5,813,655 A 9/1998 Pinchott et al.
5,819,366 A 10/1998 Edin
5,823,229 A 10/1998 Bertrand et al.
5,829,467 A 11/1998 Spicher
5,829,475 A 11/1998 Acker
5,845,844 A 12/1998 Zosimodis
5,855,356 A 1/1999 Fait
5,857,717 A 1/1999 Caffrey
5,868,311 A 2/1999 Cretu-Petra
5,872,891 A 2/1999 Son
5,941,275 A 8/1999 Laing
5,944,221 A 8/1999 Laing et al.
5,961,095 A 10/1999 Schrott
5,963,624 A 10/1999 Pope
5,966,753 A 10/1999 Gauthier et al.
5,979,776 A 11/1999 Williams
5,983,922 A 11/1999 Laing et al.
6,000,170 A 12/1999 Davis
6,003,170 A 12/1999 Humpert et al.
6,003,182 A 12/1999 Song
6,006,784 A 12/1999 Tsutsui et al.
6,019,130 A 2/2000 Rump
6,026,844 A 2/2000 Laing et al.
6,029,094 A 2/2000 Diffut
6,032,616 A 3/2000 Jones
6,042,885 A 3/2000 Woollard et al.
6,061,499 A 5/2000 Hlebovy
6,075,454 A 6/2000 Yamasaki
6,085,790 A 7/2000 Humpert et al.
6,093,313 A 7/2000 Bovaird et al.
6,101,452 A 8/2000 Krall et al.
6,132,085 A 10/2000 Bergeron
6,167,845 B1 1/2001 Decker, Sr.
6,175,689 B1 1/2001 Blanco, Jr.
6,182,683 B1 2/2001 Sisk
6,192,192 B1 2/2001 Illy et al.
6,196,065 B1 3/2001 Henksmeier et al.
6,202,980 B1 3/2001 Vincent et al.
6,227,235 B1 5/2001 Laing et al.
6,240,250 B1 5/2001 Blanco, Jr.
6,250,558 B1 6/2001 Dogre Cuevas
6,250,601 B1 6/2001 Kolar et al.
6,273,394 B1 8/2001 Vincent et al.
6,283,139 B1 9/2001 Symonds et al.
6,286,764 B1 9/2001 Garvey et al.
6,288,707 B1 9/2001 Philipp
6,290,139 B1 9/2001 Kolze
6,290,147 B1 9/2001 Bertrand et al.
6,294,786 B1 9/2001 Marcichow et al.
6,315,208 B1 11/2001 Doyle
6,317,717 B1 11/2001 Lindsey et al.
6,321,785 B1 11/2001 Bergmann
6,337,635 B1 1/2002 Ericksen et al.
6,340,032 B1 1/2002 Zosimadis
6,341,389 B2 1/2002 Philipps-Liebich et al.
6,351,603 B2 2/2002 Waithe et al.
6,363,549 B2 4/2002 Humpert et al.
6,370,713 B2 4/2002 Bosio
6,377,009 B1 4/2002 Philipp
6,389,226 B1 5/2002 Neale et al.
6,438,770 B1 8/2002 Hed et al.
6,445,306 B1 9/2002 Trovato et al.
6,446,875 B1 9/2002 Brooks et al.
6,452,514 B1 9/2002 Philipp
RE37,888 E 10/2002 Cretu-Petra
6,457,355 B1 10/2002 Philipp
6,466,036 B1 10/2002 Philipp
6,473,917 B1 11/2002 Mateina
6,474,951 B2 11/2002 Stephan et al.
6,513,787 B1 2/2003 Jeromson et al.
6,522,078 B1 2/2003 Okamoto et al.
6,535,200 B2 3/2003 Philipp
6,536,464 B1 3/2003 Lum et al.
6,549,816 B2 4/2003 Gauthier et al.
6,574,426 B1 6/2003 Blanco, Jr.
6,588,377 B1 7/2003 Leary et al.
6,598,245 B2 7/2003 Nishioka
6,612,267 B1 9/2003 West
6,619,320 B2 9/2003 Parsons
6,619,567 B1 9/2003 Ouyoung
6,622,930 B2 9/2003 Laing et al.
6,629,645 B2 10/2003 Mountford et al.
6,639,209 B1 10/2003 Patterson et al.
6,644,333 B2 11/2003 Gloodt
6,659,048 B1 12/2003 DeSantis et al.
6,676,024 B1 1/2004 McNerney et al.
6,684,822 B1 2/2004 Lieggi
6,691,338 B2 2/2004 Zieger
6,705,534 B1 3/2004 Mueller
6,707,030 B1 3/2004 Watson
6,734,685 B2 5/2004 Rudrich
6,757,921 B2 7/2004 Esche
6,768,103 B2 7/2004 Watson
6,770,869 B2 8/2004 Patterson et al.
6,779,552 B1 8/2004 Coffman
6,874,535 B2 4/2005 Parsons et al.
6,877,172 B2 4/2005 Malek et al.
6,892,952 B2 5/2005 Chang et al.
6,895,985 B2 5/2005 Popper et al.
6,913,203 B2 7/2005 DeLangis
6,955,333 B2 10/2005 Patterson et al.
6,956,498 B1 10/2005 Gauthier et al.
6,962,162 B2 11/2005 Acker
6,962,168 B2 11/2005 McDaniel et al.
6,964,404 B2 11/2005 Patterson et al.
6,964,405 B2 11/2005 Marcichow et al.
6,968,860 B1 11/2005 Haenlein et al.
6,993,607 B2 1/2006 Philipp
7,025,077 B2 4/2006 Vogel
7,069,941 B2 7/2006 Parsons et al.
7,070,125 B2 7/2006 Williams et al.
7,096,517 B2 8/2006 Gubeli et al.
7,099,649 B2 8/2006 Patterson et al.
D528,991 S 9/2006 Katsuyama
7,150,293 B2 12/2006 Jonte
7,174,577 B2 2/2007 Jost et al.
7,232,111 B2 6/2007 McDaniel et al.
7,295,190 B2 11/2007 Philipp
7,380,731 B1 6/2008 Hsu

(56) References Cited

U.S. PATENT DOCUMENTS

| | | | | |
|---|---|---|---|---|
| 7,537,195 | B2 | 5/2009 | McDaniel et al. | |
| 7,627,909 | B2 | 12/2009 | Esche | |
| 7,690,395 | B2 | 4/2010 | Jonte et al. | |
| 2001/0022352 | A1 | 9/2001 | Rudrich | |
| 2002/0007510 | A1 | 1/2002 | Mann | |
| 2002/0015024 | A1 | 2/2002 | Westerman et al. | |
| 2002/0113134 | A1 | 8/2002 | Laing et al. | |
| 2002/0117122 | A1 | 8/2002 | Lindner | |
| 2002/0148040 | A1 | 10/2002 | Mateina | |
| 2002/0179723 | A1 | 12/2002 | Wack et al. | |
| 2003/0080194 | A1 | 5/2003 | O'Hara et al. | |
| 2003/0088338 | A1 | 5/2003 | Phillips et al. | |
| 2003/0089399 | A1 | 5/2003 | Acker | |
| 2003/0125842 | A1 | 7/2003 | Chang et al. | |
| 2003/0126993 | A1 | 7/2003 | Lassota et al. | |
| 2003/0185548 | A1 | 10/2003 | Novotny et al. | |
| 2003/0213062 | A1 | 11/2003 | Honda et al. | |
| 2004/0011399 | A1 | 1/2004 | Segien, Jr. | |
| 2004/0041033 | A1 | 3/2004 | Kemp | |
| 2004/0041034 | A1 | 3/2004 | Kemp | |
| 2004/0061685 | A1 | 4/2004 | Ostergard et al. | |
| 2004/0135010 | A1 | 7/2004 | Malek et al. | |
| 2004/0149643 | A1 | 8/2004 | Vandenbelt et al. | |
| 2004/0155116 | A1 | 8/2004 | Wack et al. | |
| 2004/0206405 | A1 | 10/2004 | Smith et al. | |
| 2004/0212599 | A1 | 10/2004 | Cok et al. | |
| 2004/0262552 | A1 | 12/2004 | Lowe | |
| 2005/0001046 | A1 | 1/2005 | Laing | |
| 2005/0006402 | A1 | 1/2005 | Acker | |
| 2005/0022871 | A1 | 2/2005 | Acker | |
| 2005/0086958 | A1 | 4/2005 | Walsh | |
| 2005/0117912 | A1 | 6/2005 | Patterson et al. | |
| 2005/0121529 | A1 | 6/2005 | DeLangis | |
| 2005/0125083 | A1 | 6/2005 | Kiko | |
| 2005/0127313 | A1 | 6/2005 | Watson | |
| 2005/0133100 | A1 | 6/2005 | Bolderheij et al. | |
| 2005/0150552 | A1 | 7/2005 | Forshey | |
| 2005/0150556 | A1 | 7/2005 | Jonte | |
| 2005/0150557 | A1* | 7/2005 | McDaniel | E03C 1/055 137/624.11 |
| 2005/0151101 | A1 | 7/2005 | McDaniel et al. | |
| 2005/0194399 | A1 | 9/2005 | Proctor | |
| 2005/0199843 | A1 | 9/2005 | Jost et al. | |
| 2005/0273218 | A1 | 12/2005 | Breed et al. | |
| 2006/0066991 | A1 | 3/2006 | Hirano et al. | |
| 2006/0101575 | A1 | 5/2006 | Louis | |
| 2006/0130907 | A1 | 6/2006 | Marty et al. | |
| 2006/0130908 | A1 | 6/2006 | Marty et al. | |
| 2006/0138246 | A1 | 6/2006 | Stowe et al. | |
| 2006/0153165 | A1 | 7/2006 | Beachy | |
| 2006/0186215 | A1 | 8/2006 | Logan | |
| 2006/0200903 | A1* | 9/2006 | Rodenbeck | E03C 1/057 4/623 |
| 2006/0201558 | A1 | 9/2006 | Marty et al. | |
| 2006/0202142 | A1 | 9/2006 | Marty et al. | |
| 2006/0212016 | A1 | 9/2006 | Lavon et al. | |
| 2006/0231638 | A1 | 10/2006 | Belz et al. | |
| 2006/0231788 | A1 | 10/2006 | Cheng | |
| 2006/0238428 | A1 | 10/2006 | Schmitt et al. | |
| 2006/0238513 | A1 | 10/2006 | Philipp | |
| 2006/0283511 | A1 | 12/2006 | Nelson | |
| 2007/0001018 | A1 | 1/2007 | Schmitt et al. | |
| 2007/0057215 | A1 | 3/2007 | Parsons et al. | |
| 2007/0069168 | A1 | 3/2007 | Jonte | |
| 2007/0157978 | A1 | 7/2007 | Jonte et al. | |
| 2007/0235672 | A1 | 10/2007 | McDaniel et al. | |
| 2007/0246267 | A1 | 10/2007 | Koottungal | |
| 2007/0246550 | A1 | 10/2007 | Rodenbeck et al. | |
| 2008/0099045 | A1 | 5/2008 | Glenn et al. | |
| 2008/0111090 | A1 | 5/2008 | Schmitt | |
| 2008/0178950 | A1 | 7/2008 | Marty et al. | |
| 2008/0178957 | A1 | 7/2008 | Thomas et al. | |
| 2008/0189850 | A1 | 8/2008 | Seggio et al. | |
| 2008/0203195 | A1 | 8/2008 | Schmitt | |
| 2008/0271238 | A1 | 11/2008 | Reeder et al. | |
| 2009/0039176 | A1 | 2/2009 | Davidson et al. | |
| 2010/0012194 | A1 | 1/2010 | Jonte et al. | |
| 2010/0096017 | A1 | 4/2010 | Jonte et al. | |
| 2010/0294641 | A1 | 11/2010 | Kunkel | |

FOREIGN PATENT DOCUMENTS

| | | | |
|---|---|---|---|
| DE | 4401637 | | 5/1998 |
| DE | 19815324 | | 11/2000 |
| EP | 0961067 | B1 | 12/1999 |
| JP | 63-111383 | | 5/1988 |
| JP | 2000-073426 | | 3/2000 |
| JP | 2003-20703 | A | 1/2003 |
| JP | 2003-105817 | | 4/2003 |
| JP | 2003-293411 | | 10/2003 |
| JP | 2004-092023 | A | 3/2004 |
| JP | 2005-146551 | A | 6/2005 |
| KR | 10-1997-0700266 | | 1/1997 |
| KR | 10-2003-0008144 | | 1/2003 |
| KR | 102003-0077823 | | 10/2003 |
| KR | 20-0382786 | Y1 | 4/2005 |
| WO | WO 91/17377 | | 11/1991 |
| WO | WO 01/20204 | | 3/2001 |
| WO | WO 2004/094990 | | 11/2004 |
| WO | WO 2005/057086 | | 6/2005 |
| WO | WO 2006/136256 | | 12/2006 |
| WO | WO 2007/059051 | A2 | 5/2007 |
| WO | WO 2007/082301 | A2 | 7/2007 |
| WO | WO 2008/094651 | A1 | 8/2008 |

OTHER PUBLICATIONS

TOTO® Products, "Self-Generating EcoPower System Sensor Faucet, Standard Spout," Specification Sheet, Nov. 2002, 2 pgs.

ZURN® Plumbing Products Group, "AquaSense® Z6903 Series", Installation, Operation, Maintenance and Parts Manual, Aug. 2001, 5 pgs.

ZURN® Plumbing Products Group, "AquaSense® Sensor Faucet," Jun. 9, 2004, 2 pgs.

SLOAN® Optima® i.q. Electronic Hand Washing Faucet, Apr. 2004, 2 pgs.

Symmons®, "Ultra-Sense® Battery-Powered, Sensor-Operated Lavatory Faucet S-6080 Series," Oct. 2002, 4 pgs.

Symmons® Commercial Faucets: Reliability With a Sense of Style, 1 pg.

Symmons®, "Ultra-Sense® Sensor Faucets with Position-Sensitive Detection," Aug. 2004, 4 pgs.

Symmons®, "Ultra-Sense® Sensor Faucet with Position-Sensitive Detection," © 2001-2002, 2 pgs.

Technical Concepts International, Inc., Capri AutoFaucet® with Surround Sensor™ Technology, 500556, 500576, 500577, (undated), 1 pg.

Technical Concepts, AutoFaucet® with "Surround Sensor" Technology, Oct. 2005, 4 pgs.

Camacho et al., Freescale Semiconductor, "Touch Pad System Using MC34940/MC33794 E-Field Sensors," Feb. 2006, 52 pgs.

Philipp, "Tough Touch Screen," applicanceDESIGN, Feb. 2006, pp. 14-17.

Quantum Research Group, "E401 User Manual," at least as early as Oct. 22, 2007, 15 pgs.

Quantum Research Group, "Gorenje Puts QSlideTM Technology into Next-Generation Kitchen Hob," Feb. 8, 2006, http://www.qprox.com/news/gorenje.php, 3 pgs.

Quantum Research Group, "Qprox™ Capacitive Touch Applications," at least as early as Oct. 22, 2007, http://www.qprox.com/background/applications.php, 8 pgs.

Quantum Research Group, "QT401 QSlide™ Touch Slider IC," 2004, 16 pgs.

Quantum Research Group, "QT411-ISSG QSlide™ Touch Slider IC," 2004-2005, 12 pgs.

Sequine et al., Cypress Perform, "Application Note AN2292, Layout Guidelines for PSoC™ CapSense™" Oct. 31, 2005, 15 pgs.

Sequine et al., Cypress Perform, "Application Notes AN2233a, Capacitive Switch Scan" Apr. 14, 2005, 6 pgs.

(56) References Cited

OTHER PUBLICATIONS

Symmons, Ultra-Sense, Battery-Powered Faucets with PDS and Ultra-Sense AC Powered Faucets, © 1999-2004, 2 pgs.
Various Products (available at least before Apr. 20, 2006), 5 pgs.
Hego WaterDesign, "Touch Faucets—Amazing Futuristic Faucet Designs", Oct. 6, 2009, 3 pgs.
Dave Van Ess, Capacitive Sensing Builds a Better Water-Cooler Control, Cypress Semiconductor Corp., Nov. 2007.
Aviation Faucet System, Product Brochure, Franke Aquarotter GmbH, downloaded Oct. 1, 2012.
Springking Industry Col, Limited, Touch Sensor Faucet, Product Specification, copyright 2010 downloaded Oct. 1, 2012.

* cited by examiner

FLUID DELIVERY DEVICE WITH AN IN-WATER CAPACITIVE SENSOR

CROSS-REFERENCE TO RELATED APPLICATIONS

This application is a continuation-in-part of U.S. patent application Ser. No. 13/400,541, filed Feb. 20, 2012, which is a continuation of U.S. patent application Ser. No. 11/700,556, filed Jan. 31, 2007, now U.S. Pat. No. 8,118,240, and claims the benefit of U.S. Provisional Patent Application Ser. No. 60/794,229, filed Apr. 20, 2006, titled "ELECTRONIC USER INTERFACE FOR ELECTRONIC MIXING OF WATER FOR RESIDENTIAL FAUCETS", and U.S. Provisional Patent Application Ser. No. 60/793,885, filed Apr. 20, 2006, titled "TOUCH SENSOR", the disclosures of which are expressly incorporated by reference herein.

BACKGROUND AND SUMMARY OF THE INVENTION

The present invention relates generally to a pull-out wand for use with a faucet or other water delivery device, and in particular to a pull-out wand having one or more sensors coupled to the pull-out wand.

Pull-out wands are known. Further, proximity and touch sensors are known for use with faucets.

In an exemplary embodiment of the present disclosure, a water delivery device in fluid communication with at least one source of water positioned below a mounting deck is provided. The water delivery device comprising a base portion in fluid communication with the at least one source of water and a pull-out wand portion in fluid communication with the base portion. The pull-out wand portion having at least one water output. The pull-out wand portion being moveably between a first position proximate to the base portion and a second position spaced apart from the base portion. The water delivery device further comprising a sensor coupled to the pull-out wand portion and a valve interposed between the at least one water output of the pull-out wand portion and the at least one source of water. The valve being operable to permit communication of water provided by the at least one source of water to the at least one water output of the pull-out wand portion in a first configuration and to prevent communication of water provided by the at least one source of water to the at least one water output in a second configuration. The water delivery device further comprising a controller operably coupled to the sensor and operably coupled to the valve. The controller causes the valve to be in the first configuration in response to a first indication from the sensor.

In another exemplary embodiment of the present disclosure, a pull-out wand for use with a base portion having an associated controller which controls a flow of fluid through the base portion is provided. The pull-out wand comprising a housing moveable between a first position proximate the base portion and a second position spaced apart from the base portion; a waterway within the housing in fluid communication with the base portion; and a sensor supported by the housing. The sensor operably coupled to the associated controller of the base portion.

In a further exemplary embodiment of the present disclosure, a water delivery device for use by a user is provided. The water delivery device being in fluid communication with at least one source of water positioned below a mounting deck. The water delivery device comprising a base portion in fluid communication with the at least one source of water; a pull-out wand portion in fluid communication with the base portion and having at least one water output, a valve interposed between the at least one water output of the pull-out wand portion and the at least one source of water, an in water sensor adapted to detect if the user is contacting the water exiting the at least one water output of the pull-out wand portion, and a controller operably coupled to the in water sensor and operably coupled to the valve. The pull-out wand portion being moveably between a first position proximate to the base portion and a second position spaced apart from the base portion. The valve being operable to permit communication of water provided by the at least one source of water to the at least one water output of the pull-out wand portion in a first configuration and to prevent communication of water provided by the at least one source of water to the at least one water output in a second configuration. The controller causing the valve to remain in the first configuration in response to the in water sensor detecting the user being in contact with the water exiting the at least one water output of the pull-out wand portion.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to the precise forms disclosed. Rather, the embodiments selected for description have been chosen to enable one skilled in the art to practice the invention. Although the disclosure is described in connection with water, it should be understood that additional types of fluids may be used.

Figure 1:
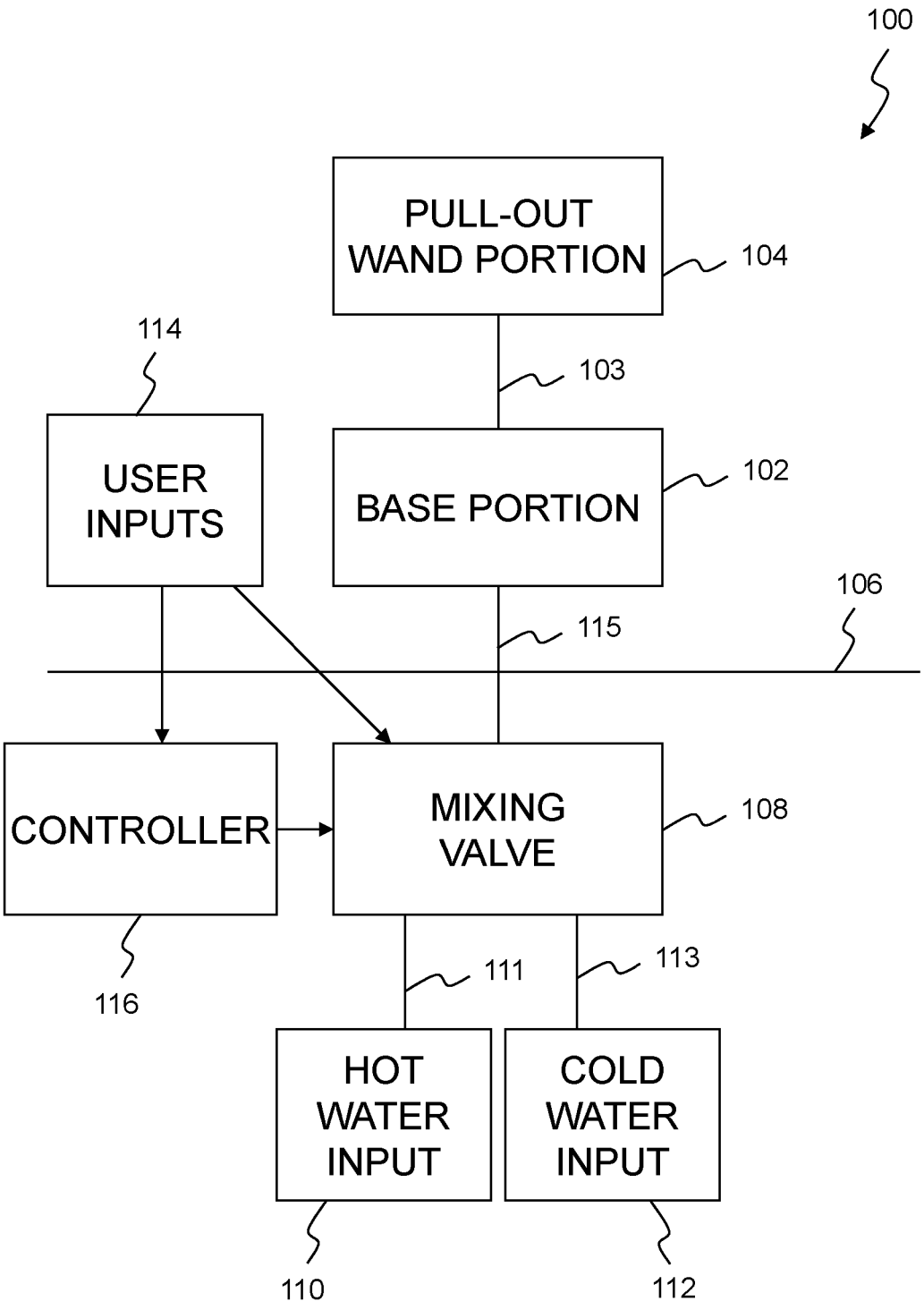
FIG. 1 is diagrammatic representation of an exemplary water delivery device.

Referring to FIG. 1, a diagrammatic representation of a water delivery device 100 is shown. Water delivery device 100 includes a base portion 102 and a pull-out wand portion 104. Base portion 102 and pull-out wand portion 104 are shown positioned on a first side of a mounting deck 106. Exemplary mounting decks include a countertop, a sink top, a tub, a wall, and other suitable mounting structures.

In one embodiment, water delivery device 100 is a residential kitchen faucet and mounting deck 106 is one of a countertop or a sink. Base portion 102 is a portion of a spout. Pull-out wand portion 104 is a portion of the spout which is moveable relative to the base portion 102 from a first position proximate the base portion 102 to a second position spaced apart from the base portion 102. One or more waterways 103 extend from the base portion 102 to the pull-out wand portion 104 when the pull-out wand portion 104 is in the second position. Exemplary spout base portions and pull-out portions and methods for coupling each are disclosed in U.S. Provisional Patent Application Ser. No. 60/794,229, filed Apr. 20, 2006, titled "ELECTRONIC USER INTERFACE FOR ELECTRONIC MIXING OF WATER FOR RESIDENTIAL FAUCETS", U.S. Published patent application Ser. No. 11/325,128, Publication No. 20060130907, titled "SPOUT ASSEMBLY FOR AN ELECTRONIC FAUCET," U.S. Published patent application Ser. No. 11/325,284, Publication No. 20060202142, titled "Method and apparatus for providing strain relief of a cable," and U.S. Published patent application Ser. No. 11/393,450, Publication No. 20060283511, titled "MAGNETIC COUPLING FOR SPRAYHEADS," the disclosures of which are expressly incorporated by reference herein.

Base portion 102 is coupled to the mounting deck 106. Pull-out wand portion 104 is coupled to and/or supported by base portion 102. Exemplary couplings between base portion 102 and pull-out wand portion 104 are mechanical couplings, such as o-rings on a docking component, and/or magnetic couplings. In the embodiment illustrated in FIG. 1, base portion 102 is in fluid communication with a mixing valve 108. Mixing valve 108 is in fluid communication with a source of hot water 110 through waterway 111 and a source of cold water 112 through waterway 113. Mixing valve 108 based on an input provided by one or more user inputs 114 regulates the temperature and/or flow of water to base portion 102 through a waterway. In a first configuration, mixing valve 108 prevents the flow of water to base portion 102. In a second configuration, mixing valve 108 permits the flow of water to base portion 102.

In one embodiment, valve 108 provides ON/OFF control. In one embodiment, valve 108 provides ON/OFF control, flow regulation and temperature regulation. In one embodiment, valve 108 is comprised of multiple valves which together provide ON/OFF control, temperature regulation, and/or flow regulation. Exemplary valves are provided in U.S. Provisional patent application Ser. No. 60/794,229, filed Apr. 20, 2006, titled "ELECTRONIC USER INTERFACE FOR ELECTRONIC MIXING OF WATER FOR RESIDENTIAL FAUCETS," U.S. patent application Ser. No. 11/109,281, filed Apr. 19, 2005, titled "ELECTRONIC PROPORTIONING VALVE," U.S. Provisional Patent Application Ser. No. 60/758,373, filed Jan. 12, 2006, titled "ELECTRONIC MIXING VALVE," and Patent Cooperation Treaty Patent Application Ser. No. PCT/US2006/044023, filed Nov. 13, 2006, titled "INTEGRATED BATHROOM ELECTRONIC SYSTEM," and the additional patents disclosed herein, the disclosures of which are expressly incorporated by reference herein.

In one embodiment, user inputs 114 directly interact with mixing valve 108, such as a handle coupled to the mixing valve and actuatable by a user. In one embodiment user inputs 114 indirectly interact with mixing valve 108, such as by providing one or more inputs to a controller 116. Exemplary inputs to controller 116 include selections made through an electronic user interface, user actuatable handles having electrical sensors associated therewith, touch sensors, and/or proximity sensors, such as infrared (IR) sensors and capacitive proximity sensors. Exemplary capacitive proximity sensors are disclosed in U.S. patent application Ser. No. 11/641,574, filed Dec. 19, 2006, titled "MULTI-MODE HANDS FREE AUTOMATIC FAUCET," U.S. Provisional Patent Application Ser. No. 60/898,524, filed Jan. 31, 2007, titled "HANDS FREE FAUCET UTILIZING NON-CONDUCTIVE MATERIALS AND CAPACITIVE SENSORS", and U.S. Provisional Patent Application Ser. No. 60/898,525, filed Jan. 31, 2007, titled "SINK BASIN CAPACITIVE SENSORS FOR HANDS FREE ACTIVATION OF A FAUCET," the disclosures of which are expressly incorporated by reference herein. In one example, the range of the capacitive proximity sensor is about 3 inches. Additional details regarding exemplary controllers, electronic user interfaces, user actuatable handles, touch sensors, and proximity sensors are provided in U.S. Provisional Patent Application Ser. No. 60/794,229, filed Apr. 20, 2006, titled "ELECTRONIC USER INTERFACE FOR ELECTRONIC MIXING OF WATER FOR RESIDENTIAL FAUCETS", the disclosure of which is expressly incorporated by reference herein.

Mixing valve 108 and controller 116 are illustrated as being positioned on an opposite side of mounting deck 106 as base portion 102 and pull-out wand portion 104. In one embodiment, one or both of mixing valve 108 and controller 116 are positioned on the same side of mounting deck 106 as base portion 102. In one embodiment, one or both of mixing valve 108 and controller 116 is incorporated into one of base portion 102 and pull-out wand portion 104. Further, in one embodiment, controller 116 includes a first controller positioned in wand portion 104 and a second controller positioned in one of base portion 102 and on an opposite side of mounting deck 106. The first controller positioned in wand portion 104 interfaces with the sensors included in wand portion 104, such as touch sensor 154 and proximity sensor 152 in FIG. 2, and, if included, any user inputs or electrically actuated valves in wand portion 104. The second controller positioned in base portion 102 or on the opposite side of mounting deck 106 interfaces with valve 108 and user inputs 114. The first controller and the second controller being in communication through either a wired or wireless connection. In a wireless connection, such as RF, wand portion 104 includes a battery to power the first controller. In one embodiment, the battery is a rechargeable battery charged with a hydrogenerator disposed in a waterway of wand portion 104.

Figure 2:
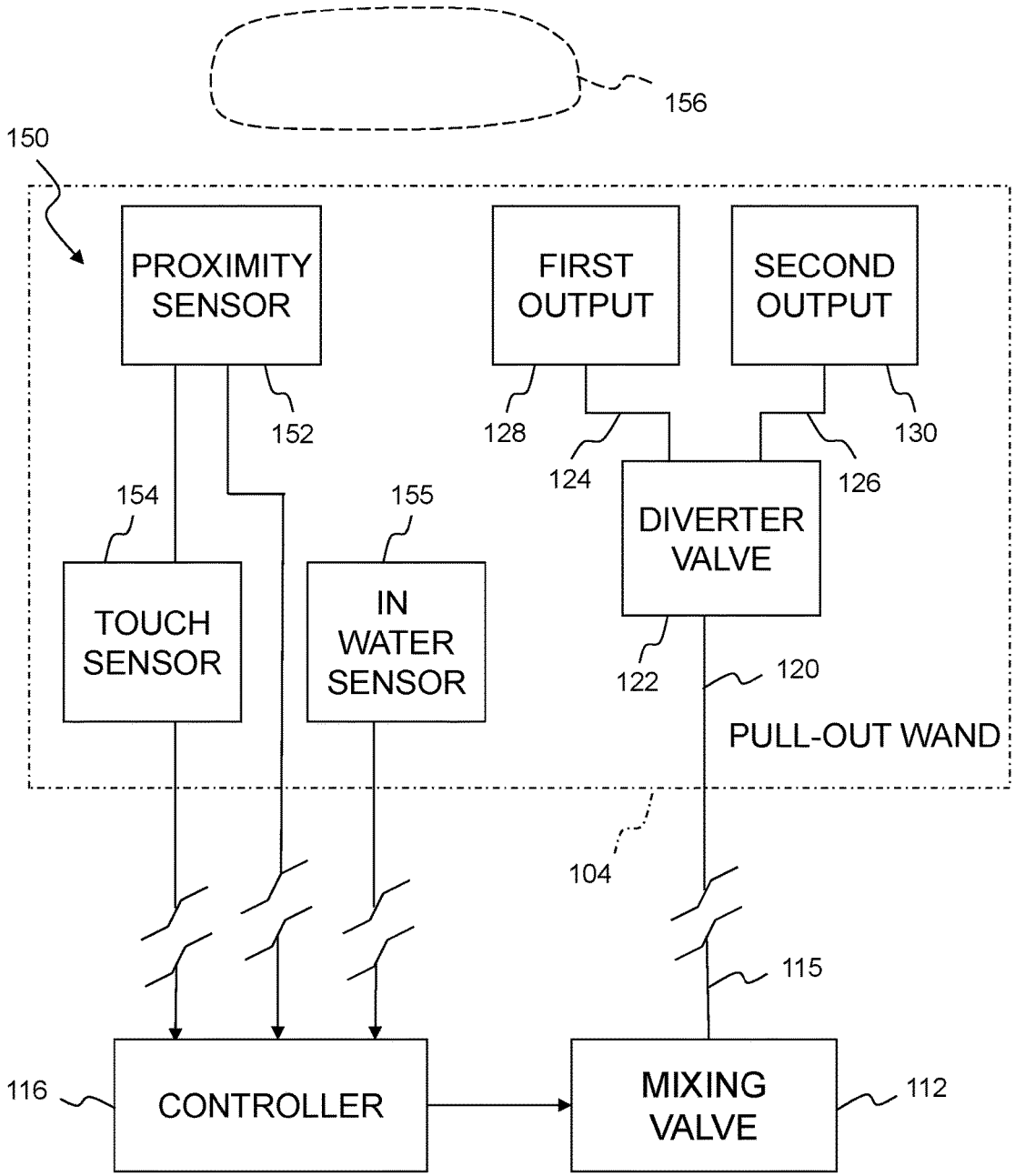
FIG. 2 is a diagrammatic representation of an exemplary embodiment of the pull-out wand of FIG. 1.

Referring to FIG. 2, a diagrammatic representation of an embodiment of pull-out wand portion 104 is shown. Pull-out wand portion 104 includes an internal waterway 120 which is in fluid communication with a waterway 103 extending between base portion 102 and pull-out wand portion 104. In one embodiment, waterway 103 and any of the additional waterways disclosed herein are made of a cross-linked polyethylene (PEX) material. In one embodiment, the PEX material is corrugated. In one embodiment, the corrugated PEX material is covered with a braiding layer as described in U.S. patent application Ser. No. 11/700,640, filed Jan. 31, 2007, titled "TUBE ASSEMBLY", the disclosure of which is expressly incorporated by reference herein.

While in one illustrative embodiment, waterway 103 and any of the additional waterways disclosed herein are made of a cross-linked polyethylene (PEX), it should be appreciated that other polymers may be substituted therefor. For example, waterway 103 and any of the additional waterways disclosed herein may be formed of any polyethylene (PE) (such as raised temperature resistant polyethylene (PE-RT)), polypropylene (PP)(such as polypropylene random (PPR)), or polybutylene (PB). It is further envisioned that waterway 103 and any of the additional waterways disclosed herein could be formed of cross-linked polyvinyl chloride (PVCX) using silane free radical initiators, from cross-linked polyurethane, or cross-linked propylene (XLPP) using peroxide or silane free radical initiators.

Waterway 120 is in further fluid communication with a diverter valve 122. Diverter valve 122 is in fluid communication with two waterways 124 and 126 which are in fluid communication with a first output 128 and a second output 130, respectively. In one embodiment, first output 128 is configured to provide water in a spray configuration and second output 130 is configured to provide water in a stream configuration.

Diverter valve 122, as is known in the art, diverts the flow of a fluid to one of plurality of potential fluid outlets based on the configuration of the valve. By adjusting the configuration of the valve the fluid outlet that fluid is provided to may be selected. Exemplary diverter valves include manually actuated valves and electrically controlled valves. An exemplary manually actuated diverter valve is a push-button diverter, such as the push-button diverter disclosed in U.S. Provisional patent application Ser. No. 60/756,839, filed Jan. 5, 2006, titled "PUSH BUTTON DIVERTER", the disclosure of which is expressly incorporated herein by reference. Exemplary electronically controlled diverter valves include solenoid valves. In one embodiment, an electronically controlled diverter valve is provided in pull-out wand portion 104 and is connected to controller 116 located in one of base portion 102 and the other side of mounting deck 106 through an electrical cable which travels along side of waterway 103. In one embodiment controller 116 includes a first controller and a second controller as discussed herein.

In one embodiment, diverter valve 122 is provided in base portion 102 or on an opposite side of mounting deck 106 as opposed to within pull-out wand portion 104. Since diverter valve 122 would not be positioned within pull-out wand portion 104, two waterways, such as waterways 124 and 126 would extend from base portion 102 to pull-out wand portion 104, each being in fluid communication with a respective outlet of diverter valve 122.

Pull-out wand portion 104 further includes one or more sensors 150. Sensors 150 are operably coupled to controller 116, through either a wired or wireless connection. In one embodiment, one or more of sensors 150 provide an indication of the presence of an object, such as a user's hands or other presentments, in a detection zone. Additional presentments are disclosed in U.S. Provisional Patent Application Ser. No. 60/794,229, filed Apr. 20, 2006, titled "ELECTRONIC USER INTERFACE FOR ELECTRONIC MIXING OF WATER FOR RESIDENTIAL FAUCETS", the disclosure of which has been incorporated by reference herein. In one embodiment, one or more of sensors 150 detect the presence of a touch by a user.

Sensors 150, in one embodiment, include a proximity sensor 152 and at least one touch sensor 154. Proximity sensor 152 monitors a detection zone 156. An exemplary proximity sensor 152 includes an IR emitter which emits IR energy into the detection zone and an IR detector which receives reflected IR energy from the detection zone. When an object, such as a user's hands, is detected in the detection zone, due to the amount of IR energy received by the IR detector, proximity sensor 152 provides an indication to controller 116. In one embodiment, controller 116 monitors a voltage corresponding to the IR level detected by the IR detector to determine when a user's hands are present in the detection zone.

Another exemplary proximity sensor is a capacitive proximity sensor. Exemplary inputs to controller 116 include selections made through an electronic user interface, user actuatable handles having electrical sensors associated therewith, touch sensors, and/or proximity sensors, such as infrared (IR) sensors and capacitive proximity sensors. Exemplary capacitive proximity sensors are disclosed in U.S. patent application Ser. No. 11/641,574, filed Dec. 19, 2006, titled "MULTI-MODE HANDS FREE AUTOMATIC FAUCET," U.S. Provisional Patent Application Ser. No. 60/898,524, filed Jan. 31, 2007, titled "HANDS FREE FAUCET UTILIZING NON-CONDUCTIVE MATERIALS AND CAPACITIVE SENSORS," and U.S. Provisional Patent Application Ser. No. 60/898,525, filed Jan. 31, 2007, titled "SINK BASIN CAPACITIVE SENSORS FOR HANDS FREE ACTIVATION OF A FAUCET," the disclosures of which are expressly incorporated by reference herein. In one example, the range of the capacitive proximity sensor is about 3 inches.

Touch sensor 154 monitors a region of pull-out wand portion 104 and provides an indication to controller 116 of a user touching that region. In one embodiment, touch sensor 154 is a capacitive sensor. Exemplary touch sensors are further described herein. In one embodiment wherein touch sensor 154 is a capacitive sensor, controller 116 monitors a capacitance of touch sensor 154 to determine when a user touches the region corresponding to the touch sensor 154.

Figure 3:
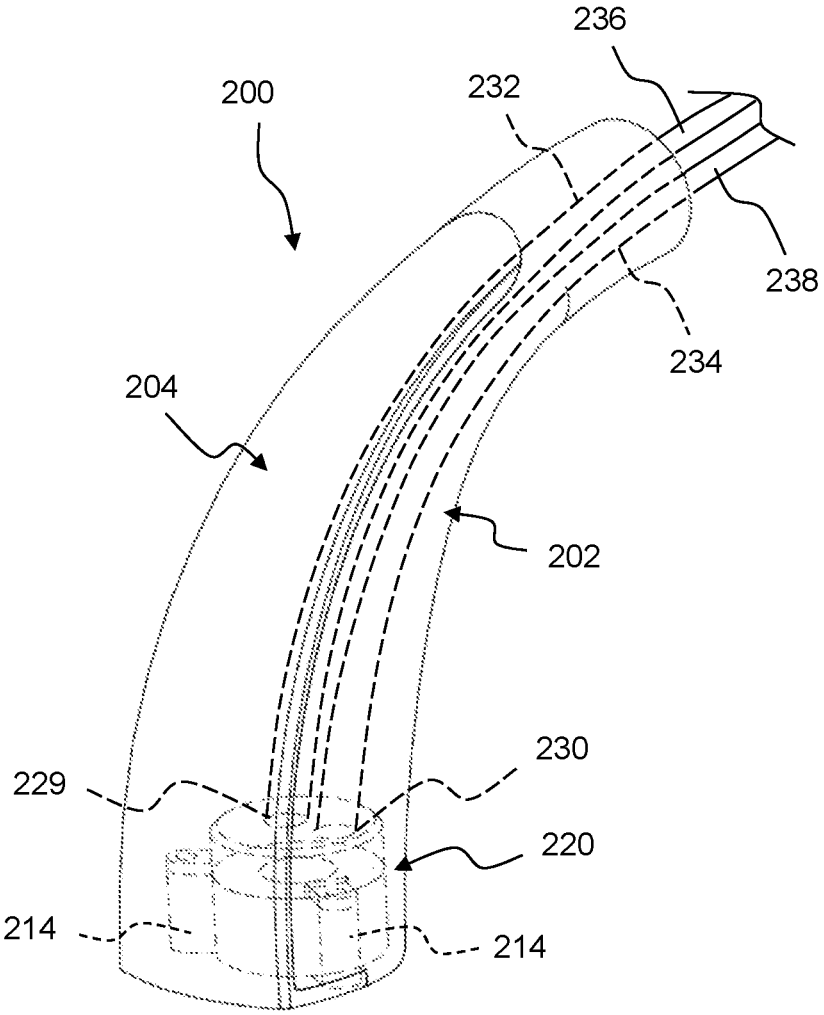
FIG. 3 is a perspective view of an exemplary pull-out wand.
Figure 5:
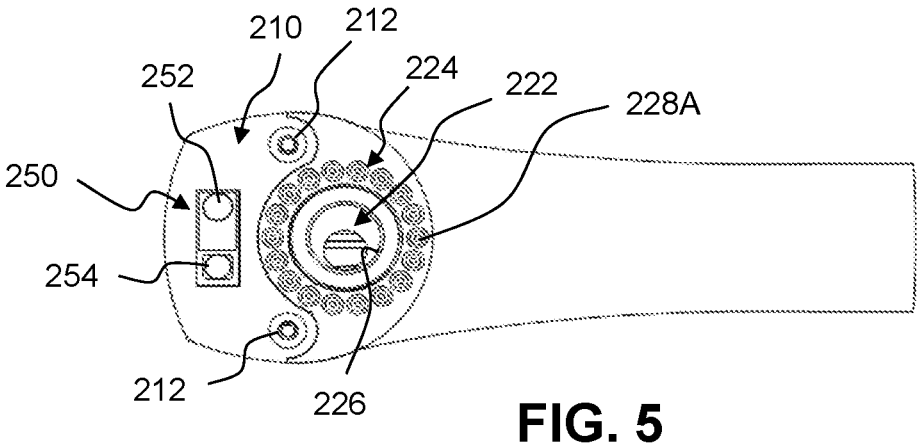
FIG. 5 is a bottom view of the exemplary pull-out wand of FIG. 3.
Figure 4:
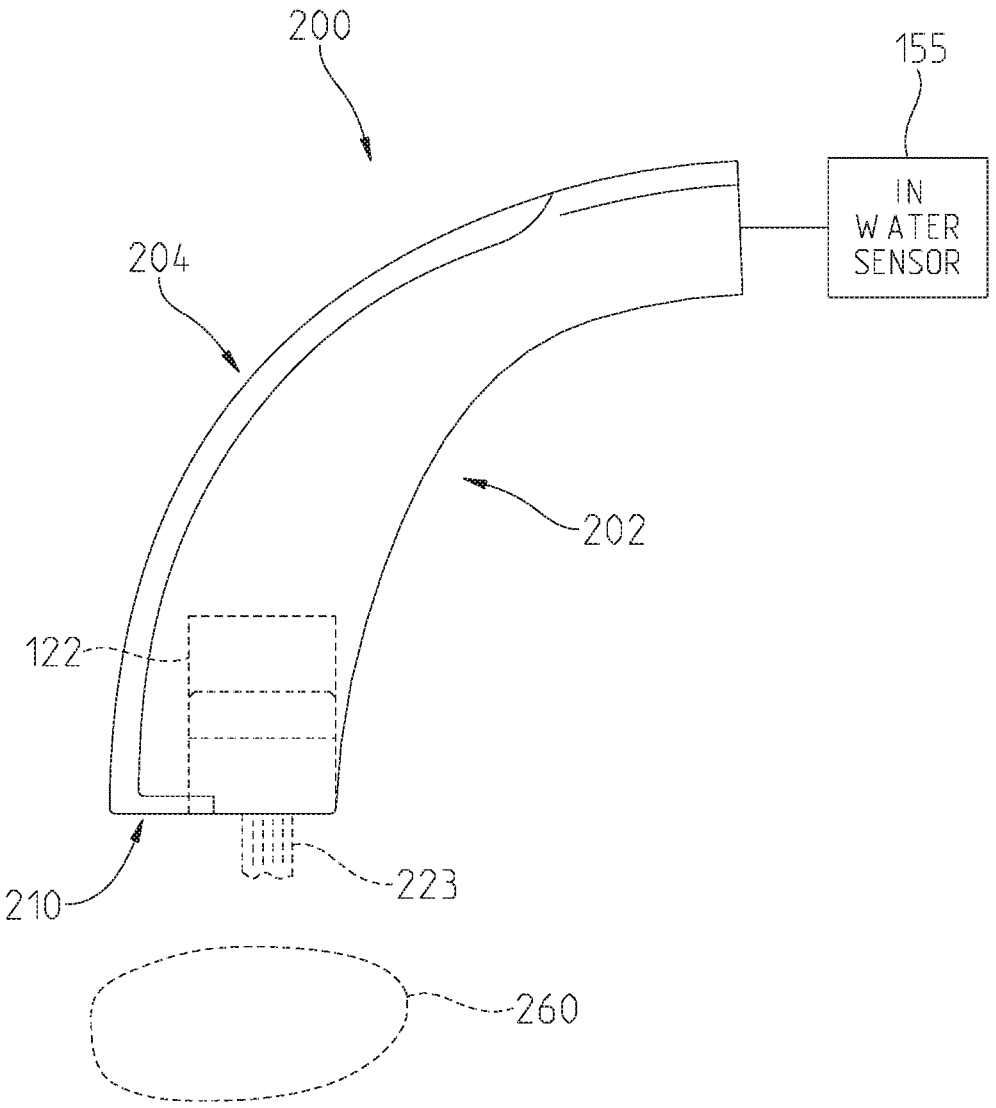
FIG. 4 is a side view of the exemplary pull-out wand of FIG. 3.
Figure 6:
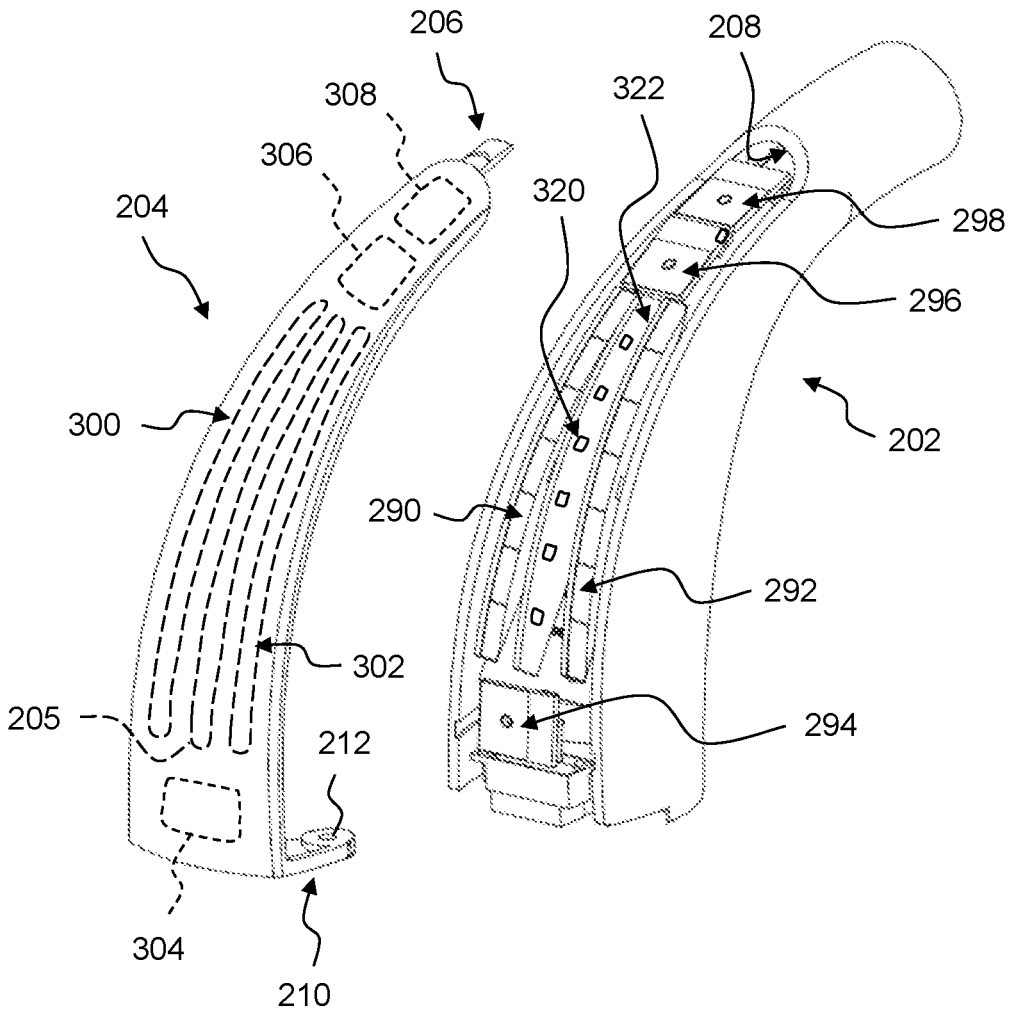
FIG. 6 is a perspective view of the exemplary pull-out wand of FIG. 3 having a cover shown in a spaced apart relationship.

Referring to FIGS. 3-9, an exemplary pull-out wand 200 is shown. Referring to FIG. 3, pull-out wand portion 200 includes a housing 202 having a removable cover 204. As shown in FIG. 6, cover 204 includes a tab 206 which is received in an opening 208 of housing 202 and an end face 210 having openings 212 which receive couplers (not shown). The couplers, such as screws, extend through the openings 212 and couple into bosses 214 of housing 202.

Bosses 214 are coupled to a sprayhead member 220. Referring to FIG. 5, sprayhead member 220 includes a first, central output 222 and a second, surrounding output 224. In one embodiment, first output 222 provides a stream configuration 223 of water and includes a threaded wall 226 for coupling an aerator assembly. First output 222 being in fluid communication with a first fluid inlet 229. In one embodiment, second output 224 includes a plurality of outlets 228, such as 228A, which are in fluid communication with a second fluid inlet 230. Second output 224 provides a spray configuration.

First fluid inlet 229 and second fluid inlet 230 are in fluid communication with waterways 232 and 234 located within housing 202, respectively. Waterways 232 and 234 are in fluid communication with waterways 236 and 238, respectively, which extend back and into a base portion, such as base portion 102. In one embodiment, waterways 232 and 234 are apart of the same tubing as waterways 236 and 238 and are called out separately to highlight their position relative to housing 202.

In one embodiment, housing 202 and cover 204 and/or base portion 102 are made of a non-metallic material. Exemplary non-metallic materials include thermoset materials. Exemplary thermoset materials include polyesters, melamine, melamine urea, melamine phenolic, and phenolic.

In one embodiment, the waterways described herein including waterways 232, 234, 236, and 238 are made from a cross-linked polyethylene (PEX) material. Additional details about PEX materials and methods for creating a waterway therefrom are found in U.S. patent application Ser. No. 11/700,640, filed Jan. 31, 2007, titled "TUBE ASSEMBLY", the disclosure of which is expressly incorporated by reference herein. In addition, further details regarding PEX materials and methods for creating a fluid transport component therefrom are found in one or more of U.S. Pat. No. 5,895,695, U.S. Pat. No. 6,082,780, U.S. Pat. No. 6,287,501, and U.S. Pat. No. 6,902,210, the disclosures of which are expressly incorporated by reference herein.

While in one illustrative embodiment, waterways 232, 234, 236, and 238 and any of the additional waterways disclosed herein are made of a cross-linked polyethylene (PEX), it should be appreciated that other polymers may be substituted therefor. For example, waterways 232, 234, 236, and 238 and any of the additional waterways disclosed herein may be formed of any polyethylene (PE)(such as raised temperature resistant polyethylene (PE-RT)), polypropylene (PP)(such as polypropylene random (PPR)), or polybutylene (PB). It is further envisioned that waterways 232, 234, 236, and 238 and any of the additional waterways disclosed herein could be formed of cross-linked polyvinyl chloride (PVCX) using silane free radical initiators, from cross-linked polyurethane, or cross-linked propylene (XLPP) using peroxide or silane free radical initiators.

Waterways 236 and 238 are in fluid communication with a diverter valve, such as diverter valve 122. In one embodiment, diverter valve 122 is positioned within housing 202 and a single waterway connects pull-out portion 200 with base portion 102.

Referring to FIG. 5, a proximity sensor 250 is located in a lower portion of housing 202. Sensor 250 includes two windows 252 and 254, through one of which infrared energy is emitted by an IR emitter, such as an LED, and through the other of which infrared energy is received and passed to an IR detector. Although sensor 250 is shown positioned forward of first outlet 222 and second output 224, sensor 250 may be positioned rearward to, to the side of, or between first outlet 222 and second output 224. In one embodiment, a capacitive proximity sensor may be used.

Sensor 250 monitors a detection zone 260 positioned generally below end face 210 of pull-out wand portion 200. In one embodiment, sensor 250 is oriented to monitor a different detection zone, such as forward of, or forward and downward of pull-out wand portion 200.

Referring to FIG. 6, pull-out wand portion 200 includes a plurality of touch sensors 290, 292, 294, 296, and 298. Touch sensors 290 and 292 are slide sensors which monitor the position of a user's finger along a corresponding region 300 and 302 of cover 204, respectively. Additional details concerning slide touch sensors 290 and 292 are provided below and in U.S. Provisional Patent Application Ser. No. 60/793,885, filed Apr. 20, 2006, titled "TOUCH SENSOR", the disclosure of which is expressly incorporated by reference herein. Touch sensors 294, 296, and 298 monitor a general region of cover 204. Illustratively regions 304, 306, and 308, respectively.

In one embodiment, cover 204 includes indicia to indicate to a user the location of touch sensors 290, 292, 294, 296, and 298 and a function associated with each touch sensor 290, 292, 294, 296, and 298. The function corresponding to the actions taken by controller 116 based on the detection of a touch by a user. Exemplary indicia and the corresponding action taken by a controller relative to a mixing valve and/or diverter valve are provided in U.S. Provisional Patent Application Ser. No. 60/794,229, filed Apr. 20, 2006, titled "ELECTRONIC USER INTERFACE FOR ELECTRONIC MIXING OF WATER FOR RESIDENTIAL FAUCETS".

Cover 204 further includes a window 205 which permits the light generated by indicator devices 320, such as LEDs, mounted to a circuit board 322 to be visible from an exterior of cover 204. In one embodiment, indicator devices 134 indicate a selected parameter of sensor 290. In one embodiment, indicator devices 134 indicate a current value of the parameter controlled by the input to sensor 290.

Tap sensors 294, 296, and 298 may comprise conventional capacitance sensors configured to provide a signal to the controller 116 in response to a user touching the corresponding tap region 304, 306, and 308. Tap sensors 294, 296, and 298 may comprise capacitive touch sensors, such as a Q-Prox™ sensor manufactured by Quantum Research Group of Hamble, United Kingdom. Tap sensors 294, 296, and 298 may operate in a manner similar to that detailed in any one of U.S. patent application Ser. No. 11/325,927, filed Jan. 5, 2006, titled "METHOD AND APPARATUS FOR DETERMINING WHEN HANDS ARE UNDER A FAUCET FOR LAVATORY APPLICATIONS"; U.S. patent application Ser. No. 11/324,901, filed Jan. 4, 2006, titled "BATTERY BOX ASSEMBLY"; U.S. patent application Ser. No. 11/325,128, filed Jan. 4, 2006, titled "SPOUT ASSEMBLY FOR AN ELECTRONIC FAUCET"; U.S. patent application Ser. No. 11/325,284, filed Jan. 4, 2006, titled "METHOD AND APPARATUS FOR PROVIDING STRAIN RELIEF OF A CABLE"; U.S. patent application Ser. No. 11/326,986, filed Jan. 5, 2006, titled "VALVE BODY ASSEMBLY WITH ELECTRONIC SWITCHING"; U.S. patent application Ser. No. 11/326,989, filed Jan. 5, 2006, titled "POSITION-SENSING DETECTOR ARRANGEMENT FOR CONTROLLING A FAUCET"; U.S. Pat. No. 6,962,168, issued Nov. 8, 2005, titled "CAPACITIVE TOUCH ON/OFF CONTROL FOR AN AUTOMATIC RESIDENTIAL FAUCET" U.S. Pat. No. 6,968,860, issued Nov. 29, 2005, titled "RESTRICTED FLOW HANDS-FREE FAUCET" U.S. Published Patent Application 2005/0151101A1, published on Jul. 14, 2005, titled "CONTROL ARRANGEMENT FOR AN AUTOMATIC RESIDENTIAL FAUCET"; and U.S. Published Patent Application 2005/0150556A1, published on Jul. 14, 2005, titled "CONTROL ARRANGEMENT FOR AN AUTOMATIC RESIDENTIAL FAUCET", the disclosures of which are expressly incorporated by reference herein.

Figure 8:
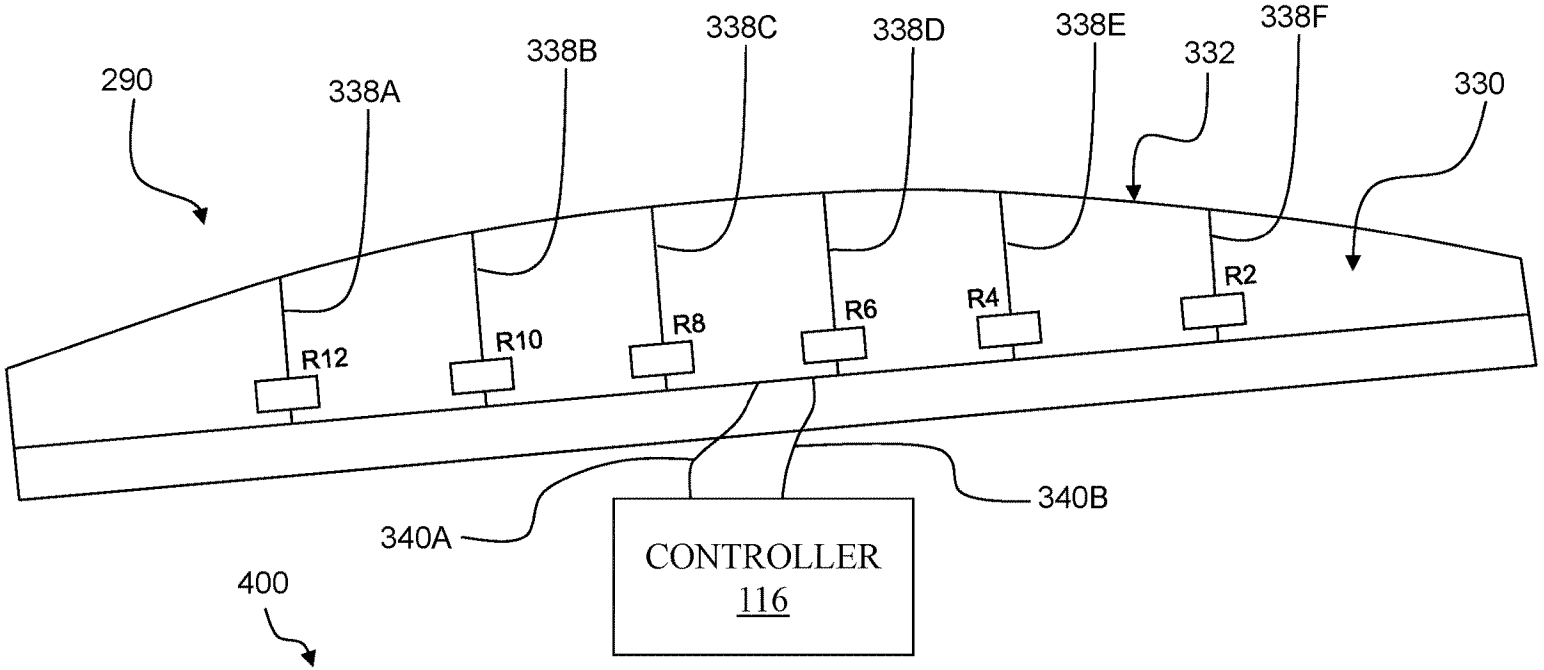
FIG. 8 is a side view of an exemplary touch sensor.

As stated above, tap sensors 290 and 292 are slide tap sensors. Referring to FIG. 8, a side view of touch sensor 290 is shown. Touch sensor 292 is the same as touch sensor 290. As such, the following discussion relative to touch sensor 290 is equally applicable to touch sensor 292.

Sensor 290 includes a base member 330 having an edge surface or side 332. In one embodiment, base member 330 is generally rigid. In the illustrated embodiment, edge surface 332 has a non-linear profile. In another embodiment, edge surface 332 has a linear profile and/or a combination of one or more linear profile segments and one or more non-linear profile segments. The profile of edge surface 332 may be selected to match a profile of cover 204.

Figure 9:
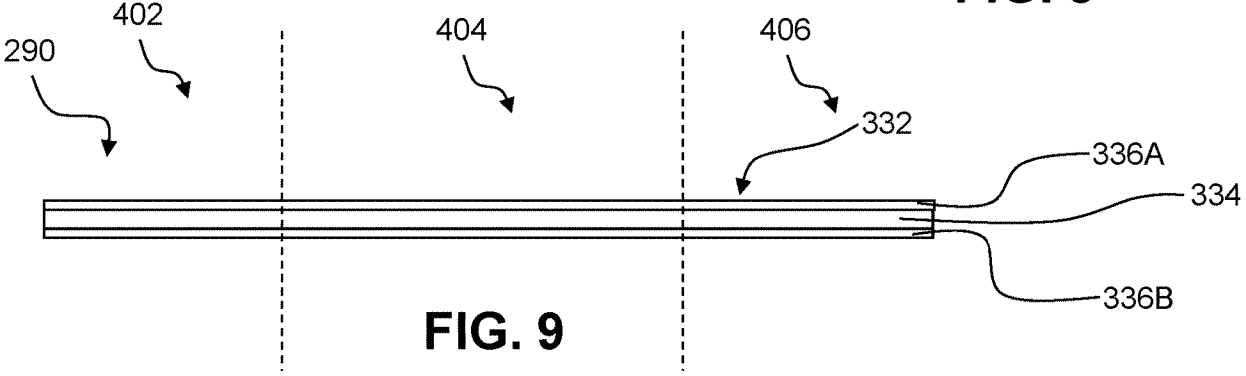
FIG. 9 is a representative top view of the touch sensor of FIG. 8.

In the illustrated embodiment, base member 330 is a printed circuit board and edge surface 332 is a side of the printed circuit board. The printed circuit board is generally rigid or stiff. Referring to FIG. 9, an exemplary representation of edge surface 332 is shown. Edge surface 332 includes a central portion 334 which is the material of the printed circuit board. Spaced apart top and bottom portions 336A and 336B are made of a conductive material, such as copper. Spaced apart portions 336A and 336B form the capacitive portion of sensor 290. Spaced apart portions 336A and 336B are shown to coincide with a top edge and a bottom edge of edge surface 332. In one embodiment, one or both of portions 336A and 336B may be offset from the respective edge of edge surface 332.

In the illustrated embodiment, the copper of portions 336A and 336B are applied to the printed circuit board such that portions 336A and 336B are a part of edge surface 332. In another embodiment, the copper is not a part of edge surface 332, but is rather backed away from edge surface 332 by an offset amount. In one example, an offset amount of up to about five thousands of an inch. In the illustrated embodiment, edge surface 332 is the material of the printed circuit board. In other embodiments edge surface 332 may be made of other materials.

Sensor 290 includes a plurality of leads 338A-F (leads are on both sides of sensor 290) which connect with copper portions 336A and 336B. These leads are coupled through resistors to two output wires 340A and 340B. Output wires 340A and 340B are coupled to controller 116 which monitors one or more electrical characteristics, such as capacitance, between wires 340A and 340B. As a user brings his or her finger into the area of a portion of edge 332, the capacitance value between wires 340A and 340B is altered. Based on the monitored capacitance value, controller 116 is able to determine the location of a user's finger along edge surface 332.

Controller 116 may detect a rapid touch of an area of edge surface 332 and/or may track the movement of a finger as it slides along edge surface 332. In one embodiment, controller 116 may distinguish between 128 various locations along edge surface 332. As illustrated in FIG. 9, in one embodiment touch sensor 290 may have multiple regions 400 associated therewith, illustratively three regions 402, 404, 406. In operation, controller 116 is capable of distinguishing between a momentary tap in one of regions 402, 404, and 406, and a continuous touch along touch sensor 290. The continuous touch is interpreted as an activation of a slide configuration of touch sensor 290, such as to directly control temperature or flow. The momentary tap is interpreted as an activation of a tap configuration of touch sensor 290 and corresponds to a given function. In the tap configuration regions 402, 404, and 406 of touch sensor 290 operate similar to touch sensors 294, 296, and 298. In one embodiment, indicia are provided on cover 204 to provide a visual cue to the operator of the function associated with regions 402, 404, and 406 of touch sensor 290.

In one embodiment, controller 116 includes the functionality of a Model No. QT401 touch slider integrated circuit or a Model No. QT411 touch slider integrated circuit both available from Quantum Research Group whose North American headquarters are located at 651 Holiday Drive, Bldg. 5/300, Pittsburgh, Pa. and covered under one or more of the following U.S. Pat. Nos. 5,730,165; 6,288,707; 6,377,009; 6,452,514; 6,457,355; 6,466,036; and 6,535,200, the disclosures of which are expressly incorporated by reference herein. In one embodiment, controller 116 utilizes PSOC CAPSENSE technology available from Cypress Semiconductor located at 198 Champion Ct., San Jose, Calif. 95134.

In one embodiment, shielding is used to improve the reliability and performance of touch sensors 290, 292, 294, 296, and 298 which are (in this embodiment) in proximity to metal enclosures of the wand and to in effect make touch sensors 290, 292, 294, 296, and 298 immune to water flowing through the wand. In one embodiment, the shielding techniques used to shield sensors from water flow and to shield sensors from metallic components disclosed in U.S. Provisional Patent Application Ser. No. 60/898,524, filed Jan. 31, 2007, titled "HANDS FREE FAUCET UTILIZING NON-CONDUCTIVE MATERIALS AND CAPACITIVE SENSORS", are used, the disclosure of which is expressly incorporated by reference herein.

Figure 7:
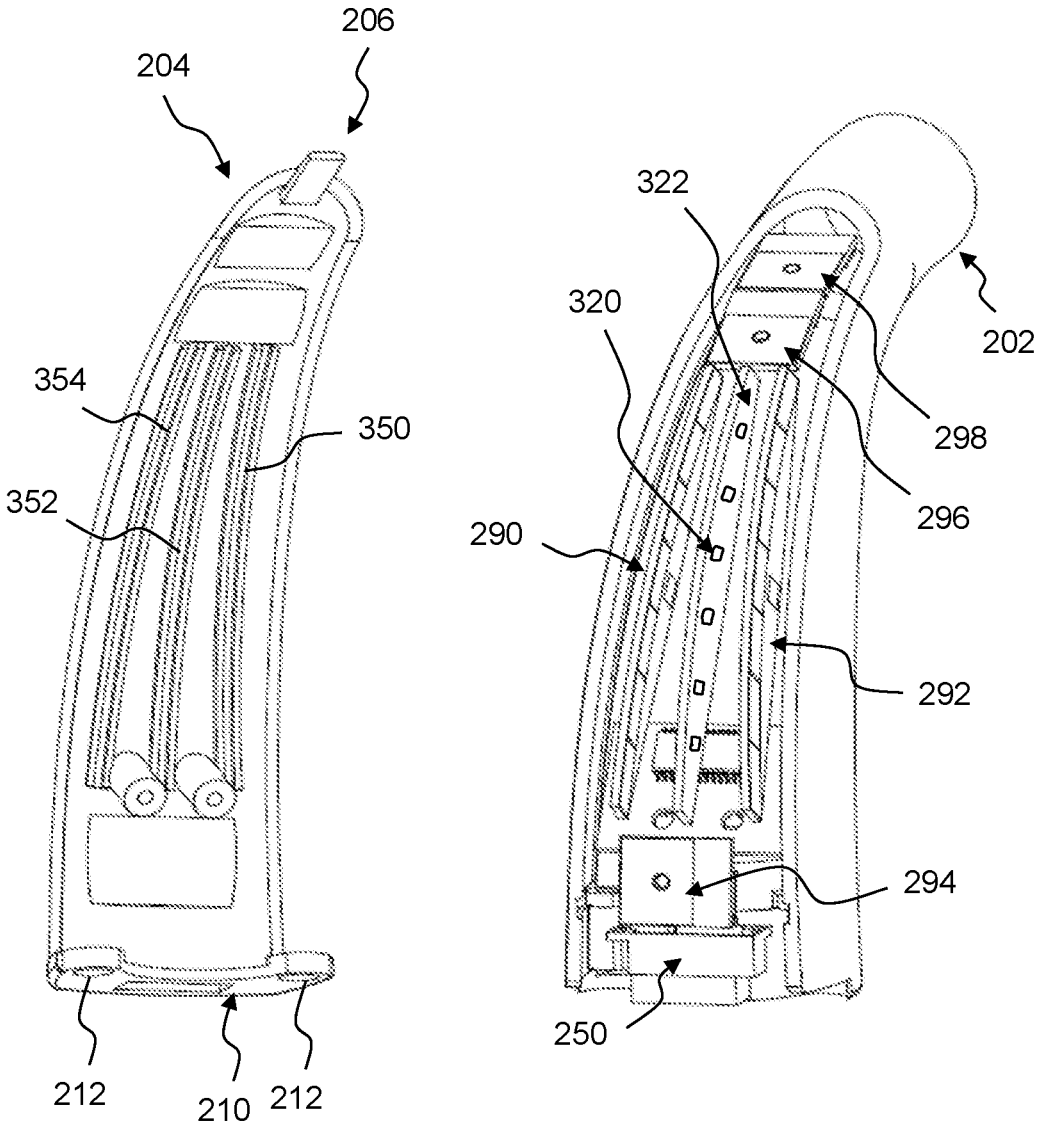
FIG. 7 is a perspective view of the exemplary pull-out wand of FIG. 3 illustrating a back portion of the cover.

Referring to FIG. 7, cover 204 includes three holders 350, 352, and 354, Holders 350 and 354 receive an edge of touch sensors 290 and 292 respectively. Holder 352 receives an edge of circuit board 322. In one embodiment, a wall thickness of cover 204 in the regions corresponding to touch sensors 290 and 292 is generally constant. In one example, the wall thickness is about 0.005 inches. In one embodiment, cover 204 is made of a polymeric material, such as plastic, which has been injection molded.

In one embodiment, pull-out wand 200 is used with a base portion 102 including additional sensors, such as touch sensors and/or proximity sensors. In one embodiment, the base portion includes a faucet handle including a touch sensor.

In one embodiment, controller 116 is connected to sensors 250 through a cable which is positioned along side waterways 236 and 238. Controller 116 is positioned below mounting deck 106. In one embodiment, controller 116 or at least a portion of controller 116 is provided in pull-out wand portion 104.

In one embodiment, a faucet having a pull-out wand may be upgraded. The existing pull-out wand is removed and replaced with pull-out wand 200. A solenoid diverter valve is included under the sink which is in fluid communication with an existing electronic mixing valve. The existing controller is updated to work with sensors 250 of pull-out wand 200.

In one embodiment, an in water sensor 155 is provided in pull-out wand 104. In water sensor 155 detects the presence of a portion of a user in the water stream output by water delivery device 100. In one embodiment, water delivery device 100 provides water at a first flow rate when a user is detected with one of proximity sensor 152 and touch sensor 154, and at a second flow rate when a user is detected with in water sensor 155. In one example, the second flow rate is higher than the first flow rate.

In one embodiment, water delivery device 100 is a faucet and in water sensor 155 detects the presence of the user's hands within an output water stream of the faucet. In an illustrative embodiment, in water sensor 155 is a capacitive sensor in communication with the controller 116. User's hands within the water stream output by the water delivery device 100 causes a change (e.g., an increase) in a capacitive sensing signal provided to the controller 116. Movement of a user's hands within the water stream output by the water delivery device 100 causes instability in the capacitive sensing signal provided to the controller 116. Illustratively, the controller 116 may determine the time or duration that a user's hands are in the water stream and/or moving in the water stream. This information may be provided to an output (e.g., a user interface, such as a display) to provide an indication of hand washing duration and/or compliance with hand washing protocols.

Additional details regarding illustrative capacitive sensors are provided in U.S. patent application Ser. No. 11/641,574, filed Dec. 19, 2006, titled "MULTI-MODE HANDS FREE AUTOMATIC FAUCET," U.S. Provisional Patent Application Ser. No. 60/898,524, filed Jan. 31, 2007, titled "HANDS FREE FAUCET UTILIZING NON-CONDUCTIVE MATERIALS AND CAPACITIVE SENSORS", U.S. Provisional Patent Application Ser. No. 60/898,525, filed Jan. 31, 2007, titled "SINK BASIN CAPACITIVE SENSORS FOR HANDS FREE ACTIVATION OF A FAUCET," and U.S. Patent Application Publication No. 2012/0055557, filed Sep. 2, 2011, titled "FAUCET INCLUDING A CAPACITANCE BASED SENSOR", the disclosures of which are expressly incorporated by reference herein.

Compliance with hand hygiene protocols may be measured by the in-water capacitive sensor 155 determining that the user's hands are placed and/or moving in the water stream discharged from spout outlet for a period of time. This can be sensed by an absolute shift in measured capacitance (e.g., placement of hands in the water stream) or relative and random signal changes in the capacitive signal (e.g., movement of hands in the water stream) indicative of hand washing activity.

The pull-out wand portions 104, 200 described herein may be incorporated into the water delivery systems, such as faucets, described in U.S. Provisional Patent Application Ser. No. 60/794,229, filed Apr. 20, 2006, titled "ELECTRONIC USER INTERFACE FOR ELECTRONIC MIXING OF WATER FOR RESIDENTIAL FAUCETS", U.S. Pat. No. 6,962,168, U.S. Pat. No. 6,968,860, U.S. Pat. No. 7,150,293, U.S. patent application Ser. No. 11/641,574, filed Dec. 19, 2006, titled "MULTI-MODE HANDS FREE AUTOMATIC FAUCET," U.S. patent application Ser. No. 10/755,582, filed Jan. 12, 2004, titled "CONTROL ARRANGEMENT FOR AN AUTOMATIC RESIDENTIAL FAUCET," U.S. patent application Ser. No. 11/324,901, filed Jan. 4, 2006, titled "BATTERY BOX ASSEMBLY," U.S. patent application Ser. No. 11/326,989, filed Jan. 5, 2006, titled "POSITION-SENSING DETECTOR ARRANGEMENT FOR CONTROLLING A FAUCET," and U.S. patent application Ser. No. 11/326,986, filed Jan. 5, 2006, titled "VALVE BODY ASSEMBLY WITH ELECTRONIC SWITCHING," the disclosures of which are expressly incorporated by reference herein.

Although the invention has been described in detail with reference to certain preferred embodiments, variations and modifications exist within the spirit and scope of the invention as described and defined in the following claims.

The invention claimed is:

1. A water delivery device for use by a user, the water delivery device being in fluid communication with at least one source of water positioned below a mounting deck, the water delivery device comprising:

a base portion in fluid communication with the at least one source of water;

at least one water output supported by the base portion;

a valve interposed between the at least one water output and the at least one source of water, the valve being operable to permit communication of water provided by the at least one source of water to the at least one water output in a first configuration and to prevent communication of water provided by the at least one source of water to the at least one water output in a second configuration;

an in water sensor which detects if the user is contacting the water exiting the at least one water output, wherein the in water sensor is a capacitive sensor;

an electronic controller operably coupled to the in water sensor and operably coupled to the valve, the electronic controller causing the valve to remain in the first configuration in response to the in water sensor detecting the user being in contact with the water exiting the at least one water output; and at least one of a proximity sensor and a touch sensor, the electronic controller causing the valve to be in the first configuration in response to a first indication from the at least one of the proximity sensor and the touch sensor, wherein the electronic controller causes the valve to provide water at a first flow rate in response to the first indication from the at least one of the proximity sensor and the touch sensor and to provide water at a second flow rate in response to the in water sensor detecting the user being in contact with the water exiting the at least one water output.

2. The water delivery device of claim 1, further comprising a pull-out wand portion in fluid communication with the base portion and defining the at least one water output, the pull-out wand portion being moveable between a first position proximate to the base portion and a second position spaced apart from the base portion.

3. The water delivery device of claim 2, further comprising a fluid characteristic input electronic touch sensor supported by the pull-out wand portion, the fluid characteristic input electronic touch sensor adapted to detect a movement of an object contacting the pull-out wand portion along an exterior of the pull-out wand portion, the electronic controller further controlling a fluid characteristic of the water exiting the at least one water output based on an input of the fluid characteristic input electronic touch sensor.

4. The water delivery device of claim 1, wherein the second flow rate is higher than the first flow rate.

5. The water delivery device of claim 1, wherein the valve is a mixing valve.

6. The water delivery device of claim 1, wherein the at least one of the proximity sensor and the touch sensor is defined by the capacitive sensor.

7. The water delivery device of claim 1, wherein the electronic controller is configured to provide an indication of hand washing duration in response to the in water sensor detecting a user contacting the water exiting the at least one water output.

8. A faucet in fluid communication with at least one source of water positioned below a mounting deck, the water delivery device comprising:

a spout in fluid communication with the at least one source of water;

at least one water output supported by the spout;

an in water sensor which detects if the user is contacting the water exiting the at least one water output, wherein the in water sensor is a capacitive sensor;

a valve interposed between the at least one water output and the at least one source of water, the valve being operable to permit communication of water provided by the at least one source of water to the at least one water output in a first configuration and to prevent communication of water provided by the at least one source of water to the at least one water output in a second configuration;

an electronic controller operably coupled to the valve;

at least one of a proximity sensor and a first touch sensor, the electronic controller causing the valve to be in the first configuration in response to a first indication from the at least one of the proximity sensor and the first touch sensor, wherein the electronic controller causes the valve to provide water at a first flow rate in response to the first indication from the at least one of the proximity sensor and the first touch sensor; and wherein the electronic controller causes the valve to provide water at a second flow rate in response to the in water sensor detecting the user being in contact with the water exiting the at least one water output.

9. The faucet of claim 8, wherein the second flow rate is higher than the first flow rate.

10. The faucet of claim 8, further comprising a pull-out wand portion in fluid communication with the spout and defining the at least one water output, the pull-out wand portion being moveably between a first position proximate to the spout and a second position spaced apart from the spout.

11. The faucet of claim 8, further comprising a fluid characteristic input electronic touch sensor operably coupled to the electronic controller, the fluid characteristic input electronic touch sensor adapted to detect a movement of an object contacting an exterior of the water delivery device.

12. The faucet of claim 11, wherein the electronic controller further controls a fluid characteristic of the water exiting the at least one water output based on an input of the fluid characteristic input electronic touch sensor.

13. The faucet of claim 12, wherein the fluid characteristic input electronic touch sensor is a slide sensor.

14. The faucet of claim 12, wherein the fluid characteristic input electronic touch sensor includes a rigid base member including a non-linear surface; and at least two spaced apart conductors positioned along the non-linear surface, the at least two spaced apart conductors form a capacitive sensor.

15. The faucet of claim 14, wherein the rigid base member is a printed circuit board and the non-linear surface is an edge of the printed circuit board.

16. The faucet of claim 8, wherein the valve is a mixing valve.

17. The faucet of claim 8, wherein the at least one of the proximity sensor and the first touch sensor is defined by the capacitive sensor.

18. The faucet of claim 8, wherein the electronic controller is configured to provide an indication of hand washing duration in response to the in water sensor detecting a user contacting the water exiting the at least one water output.

19. A water delivery device for use by a user, the water delivery device being in fluid communication with at least one source of water, the water delivery device comprising:

a base portion in fluid communication with the at least one source of water;

at least one water output supported by the base portion;

a valve interposed between the at least one water output and the at least one source of water, the valve being operable to selectively permit and prevent communication of water provided by the at least one source of water to the at least one water output;

a proximity sensor and an in water sensor defined by a capacitive sensor;

wherein the proximity sensor detects if the user is in proximity of the base portion, and the in water sensor detects if the user is contacting the water exiting the at least one water output;

an electronic controller operably coupled to the capacitive sensor and the valve; and wherein the electronic controller causes the valve to provide water at a first flow rate to the at least one water output in response to user input from the proximity sensor detecting a user in proximity to the base portion, and causes the valve to provide water at a second flow rate to the least one water output in response to user input from the in water sensor detecting a user contacting the water exiting the at least one water output.

20. The water delivery device of claim 19, wherein the valve is operable to permit communication of water provided by the at least one source of water to the at least one water output in a first configuration and to prevent communication of water provided by the at least one source of water to the at least one water output in a second configuration, and the electronic controller causes the valve to remain in the first configuration in response to the in water sensor detecting the user being in contact with the water exiting the at least one water output.

21. The water delivery device of claim 19, wherein the second flow rate is greater than the first flow rate.

* * * * *